US008453834B2

(12) United States Patent
Porter

(10) Patent No.: US 8,453,834 B2
(45) **Date of Patent: *Jun. 4, 2013**

(54) APPARATUS FOR INTERNAL MIXTURE OF SUBSTANCES

(75) Inventor: John Porter, Epping, NH (US)

(73) Assignee: Granite State Product Development LLC, Dover, DE (US)

( * ) Notice: Subject to any disclaimer, the term of this patent is extended or adjusted under 35 U.S.C. 154(b) by 409 days.

This patent is subject to a terminal disclaimer.

(21) Appl. No.: 12/761,056

(22) Filed: Apr. 15, 2010

(65) Prior Publication Data

US 2011/0068102 A1 Mar. 24, 2011

Related U.S. Application Data

(63) Continuation-in-part of application No. 12/562,361, filed on Sep. 18, 2009.

(51) Int. Cl.
*B65D 51/28* (2006.01)

(52) U.S. Cl.
USPC ..... 206/222; 222/144.5; 222/145.5; 222/521

(58) Field of Classification Search
USPC ..... 206/219, 220, 221, 222; 220/521, 220/145.1, 144.5
See application file for complete search history.

(56) References Cited

U.S. PATENT DOCUMENTS

| | | | |
|---|---|---|---|
| 3,305,368 | A | 2/1967 | Bourelle |
| 3,326,363 | A | 6/1967 | Bennet et al. |
| 3,743,520 | A | 7/1973 | Croner |
| 3,779,372 | A | 12/1973 | de Lioret |
| 3,796,813 | A | 3/1974 | Kurland |
| 4,195,730 | A | 4/1980 | Hunt |
| 4,634,003 | A | 1/1987 | Ueda et al. |
| 4,784,678 | A | 11/1988 | Rudick et al. |
| 4,785,931 | A | 11/1988 | Weir et al. |
| 5,035,320 | A | 7/1991 | Plone |
| 5,123,574 | A | 6/1992 | Poulos |
| 5,431,276 | A | 7/1995 | Lialin |
| 5,529,179 | A | 6/1996 | Hanson |
| 5,711,420 | A | 1/1998 | Spring |
| 5,772,017 | A | 6/1998 | Kang |
| 5,885,635 | A | 3/1999 | Spring et al. |
| 5,934,493 | A | 8/1999 | Han |
| 5,979,647 | A | 11/1999 | Kan |
| 6,305,576 | B1 | 10/2001 | Leoncavallo |

(Continued)

FOREIGN PATENT DOCUMENTS

WO WO 2007-082464 7/2007

OTHER PUBLICATIONS

ISR and Written Opinion in PCT/US2010/049035 dated Jun. 3, 2011, 9 pages.

*Primary Examiner* — Tony G Soohoo
(74) *Attorney, Agent, or Firm* — Duane Morris LLP

(57) ABSTRACT

A device for mixture of substances, whether in the form of a fixed or removable cap or in the form of emersion within a container, utilizing individual internal substance compartments, controlled by an external actuation mechanism. The system actuation mechanism can be placed in a locked position for storage, shipping or to ensure integrity of solutions. Multiple compartments may be utilized, as well as multiple compartments within an individual container to produce multiple mixtures. A further embodiment encompassing a pivotal actuator and removably attached mixing mechanisms is also illustrated.

26 Claims, 20 Drawing Sheets

U.S. PATENT DOCUMENTS

| | | | | |
|---|---|---|---|---|
| 6,708,735 | B1 | 3/2004 | Kenihan | |
| 6,763,939 | B2 | 7/2004 | Alticosalian | |
| 6,840,373 | B2 | 1/2005 | Gibler et al. | |
| 6,874,551 | B1 | 4/2005 | Snell et al. | |
| 6,976,578 | B1 | 12/2005 | Kenihan | |
| 7,163,129 | B1 | 1/2007 | Bennett | |
| 7,306,117 | B2 | 12/2007 | Roth et al. | |
| 7,681,726 | B2 * | 3/2010 | O'Donnell et al. | 206/222 |
| 2002/0050461 | A1 | 5/2002 | Vlodek | |
| 2002/0157970 | A1 | 10/2002 | Carlson | |
| 2007/0074979 | A1 | 4/2007 | Cho | |
| 2008/0041738 | A1 * | 2/2008 | O'Donnell et al. | 206/219 |
| 2008/0067084 | A1 | 3/2008 | Patterson et al. | |
| 2010/0044377 | A1 * | 2/2010 | Porter | 220/212 |
| 2011/0068102 | A1 * | 3/2011 | Porter | 220/212 |

* cited by examiner

APPARATUS FOR INTERNAL MIXTURE OF SUBSTANCES

CROSS-REFERENCE TO RELATED CASES

This application is a continuation-in-part of a co-pending U.S. application Ser. No. 12/562,361 filed on Sep. 18, 2009, the contents of which are incorporated herein by reference in its entirety.

FIELD OF THE INVENTION

The present disclosure relates generally to a container lid and more particularly to an attachable container lid containing compartments for holding and selectively dispensing additive substances.

BACKGROUND

Containers of various designs for separately holding additive substances until they are ready to be mixed with a solvent fluid are known. However, many are limited in their capacity to hold different number of component substances and impractical in configuration for efficient manufacturing. Thus, there is a need for improved lid for a container.

SUMMARY

According to an embodiment of the present disclosure, a container lid for mixture of two or more substances is disclosed. The container lid comprises a top portion provided with an actuator and a main portion, wherein the top portion and the main portion are rotatably attached to each other and rotatable about the central axis of the container lid. The main portion of the container lid is comprised of a closed top end, open bottom end and a central axis, wherein the top end is operably connected to the top portion. The main portion of the container lid also includes three or more compartments having closed top ends and open bottom ends. The closed top ends of the three or more compartments are incorporated into the closed top end of the main portion of the container lid. A plunger member is provided within each of the three or more compartments and the plunger members are connected to the closed top ends of the three or more compartments. The top portion and the main portion are rotatably attached to each other and rotatable about the central axis of the main portion. One of the three or more compartments is a major compartment that is larger than the other of the three or more compartments. The plunger member of the major compartment is positioned along the central axis and the actuator is always in alignment with the plunger mechanism of the major compartment. The plunger members of the other of the three or more compartments are equidistant in radial direction from the central axis.

According to another embodiment, the container lid for mixture of two or more substances further includes a sealing member closing the open bottom ends of the three or more compartments. When the plunger member is moved from its initial position to an actuated position by aligning the actuator to the compartment associated with the particular plunger member and pushing down on the actuator, the plunger member is urged against the sealing member and unseals the sealing member.

The container lid of the present disclosure can be utilized to introduce a selection of additives to a primary substance to provide a mixture. For example, configuring the container of the present disclosure into a cap for a bottled water, a selection of flavoring additives can be discharged into the bottle when desired to produce flavored water drink.

The cap or lid is designed to be packaged with a plunger member in an initial neutral position for shipping which prevents accidental triggering of the plunger member. The container lid can be configured to be threaded or screwed on to another container such as a beverage bottle. In another embodiment, the container lid can be molded over a metal bottle cap that will contain holes for accommodating the actuating plunger member.

Thus, the container lid of the present disclosure can be used for flavoring various types of beverages, for adding additives to liquid medicines, or adding a desired scent to a liquid cleaner, for example. The container lid can also be used for introducing precisely pre-measured amounts of chemical components for making mixtures or solutions, such as, the components of multi-part epoxies.

The container lid of the present disclosure provides an apparatus for the internal mixture of substances that is easy and convenient to use. The container of the present disclosure provides a compartmentalized mixture of fluids and thus utilization of more than one flavor independently or together. The contents of the differing compartments may be interspersed at the choice of the user.

BRIEF DESCRIPTION OF THE DRAWINGS

These and other features and advantages of the present invention will be more fully disclosed in the following detailed description of a preferred embodiment of the invention, which is to be considered together with the accompanying drawings wherein like numbers refer to like parts. All drawing figures are schematic and are not intended to show true dimensions or true dimensional relationship among the structures.

DETAILED DESCRIPTION

Figure 1:
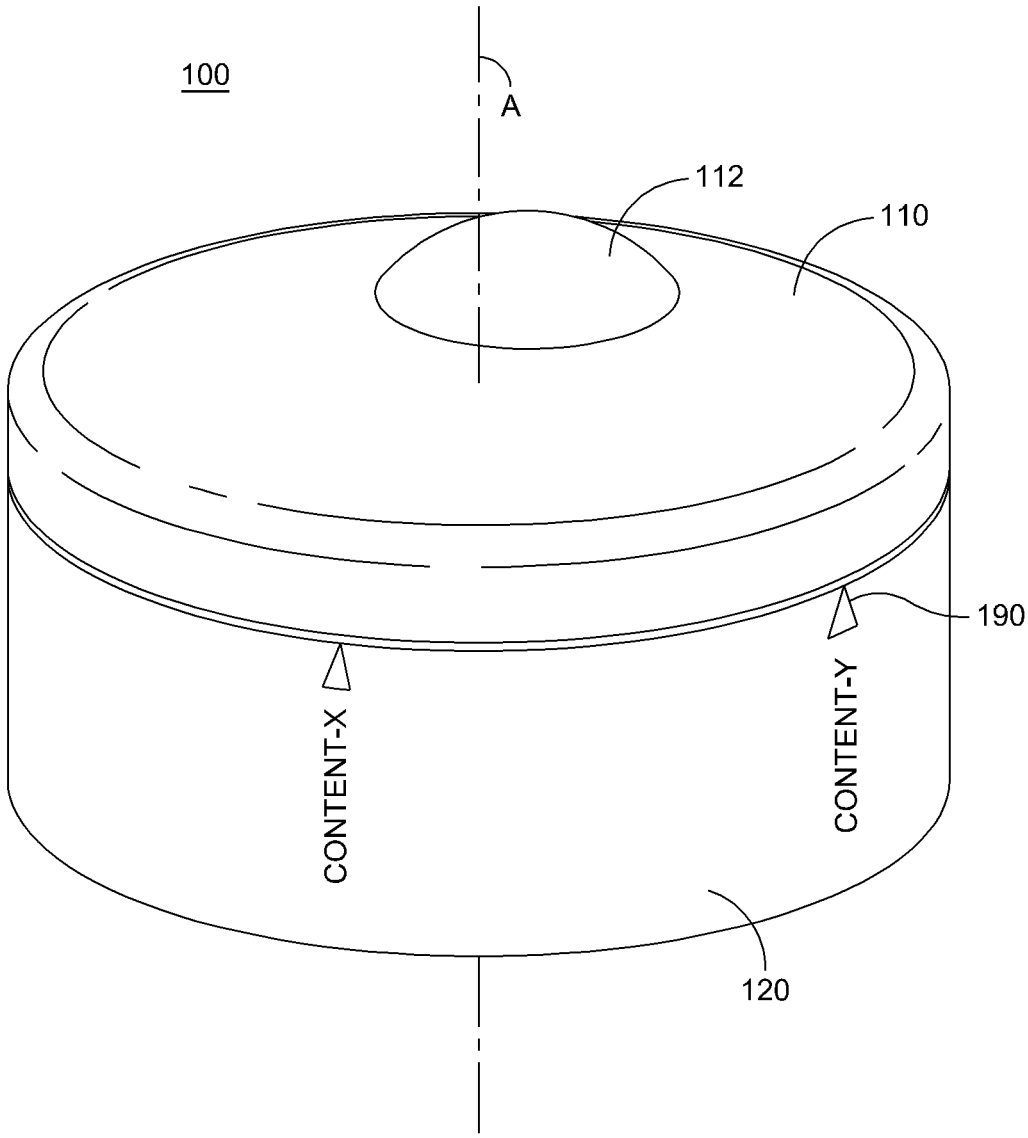
FIG. 1 is an isometric view of the container lid according to an embodiment.
Figure 2:
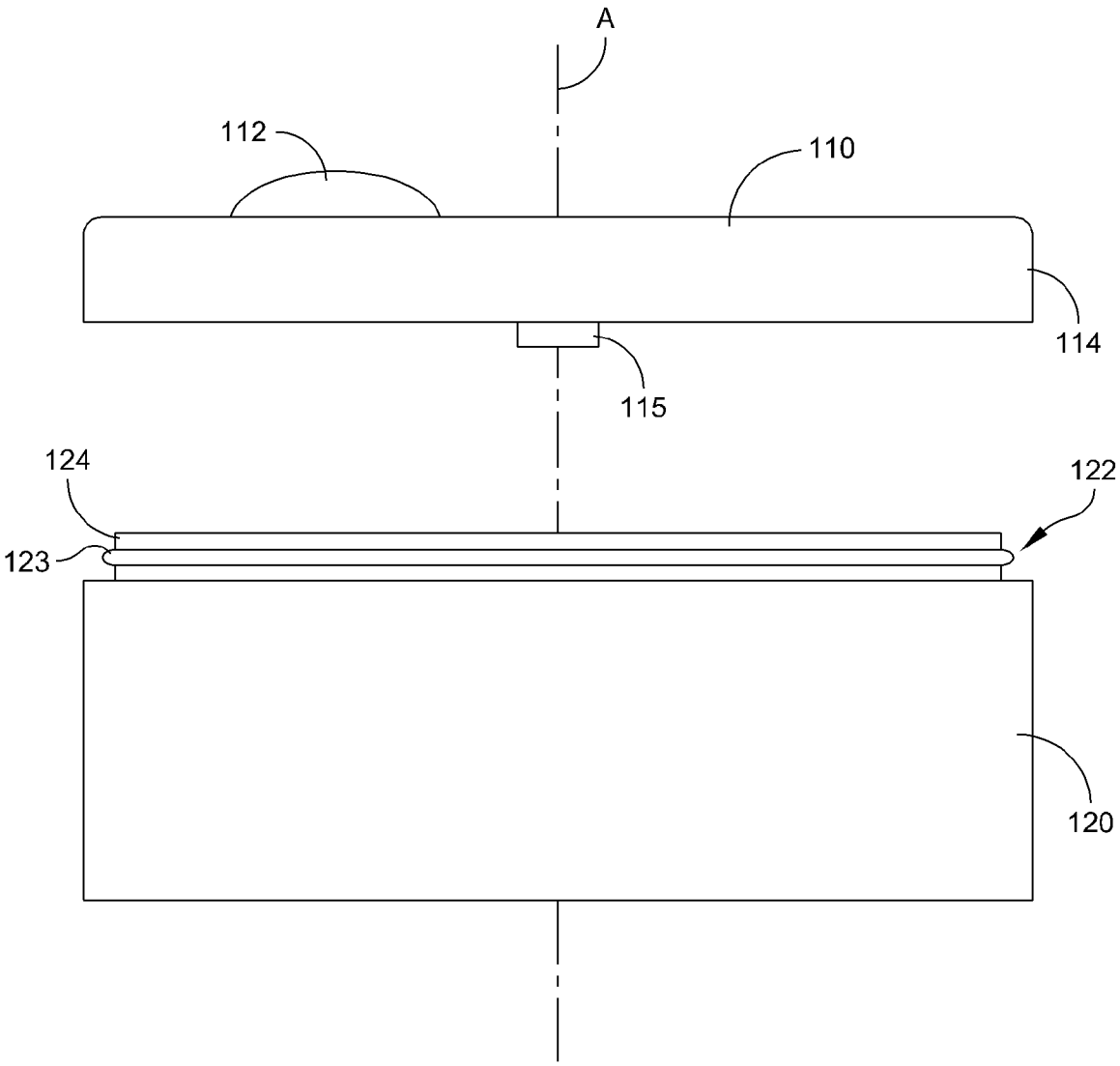
FIG. 2 is an exploded side view of the container lid of FIG. 1 illustrating the top portion separated from the main portion of the container lid.

FIGS. 1 and 2 show a container lid 100 for holding two or more additive substances to be selectively discharged into a container according to an embodiment of the present disclosure. The container lid 100 comprises a top portion 110 and a main portion 120. An actuator button 112 for actuating the container lid 100 is provided on the top portion 110.

The top portion 110 and the main portion 120 are configured and adapted to be rotatably connected so that the top portion 110 and the main portion 120 are rotatable relative to each other about the central axis A of the container lid 100. The top peripheral region 122 of the main portion 120 is configured and adapted for rotatably engaging the top portion 120. The top peripheral region 122 comprises a substantially vertical annular wall portion 124. The vertical annular wall 124 is provided with a protruding ridge 123 that circumscribes the outer surface of the vertical annular wall 124.

Figure 4:
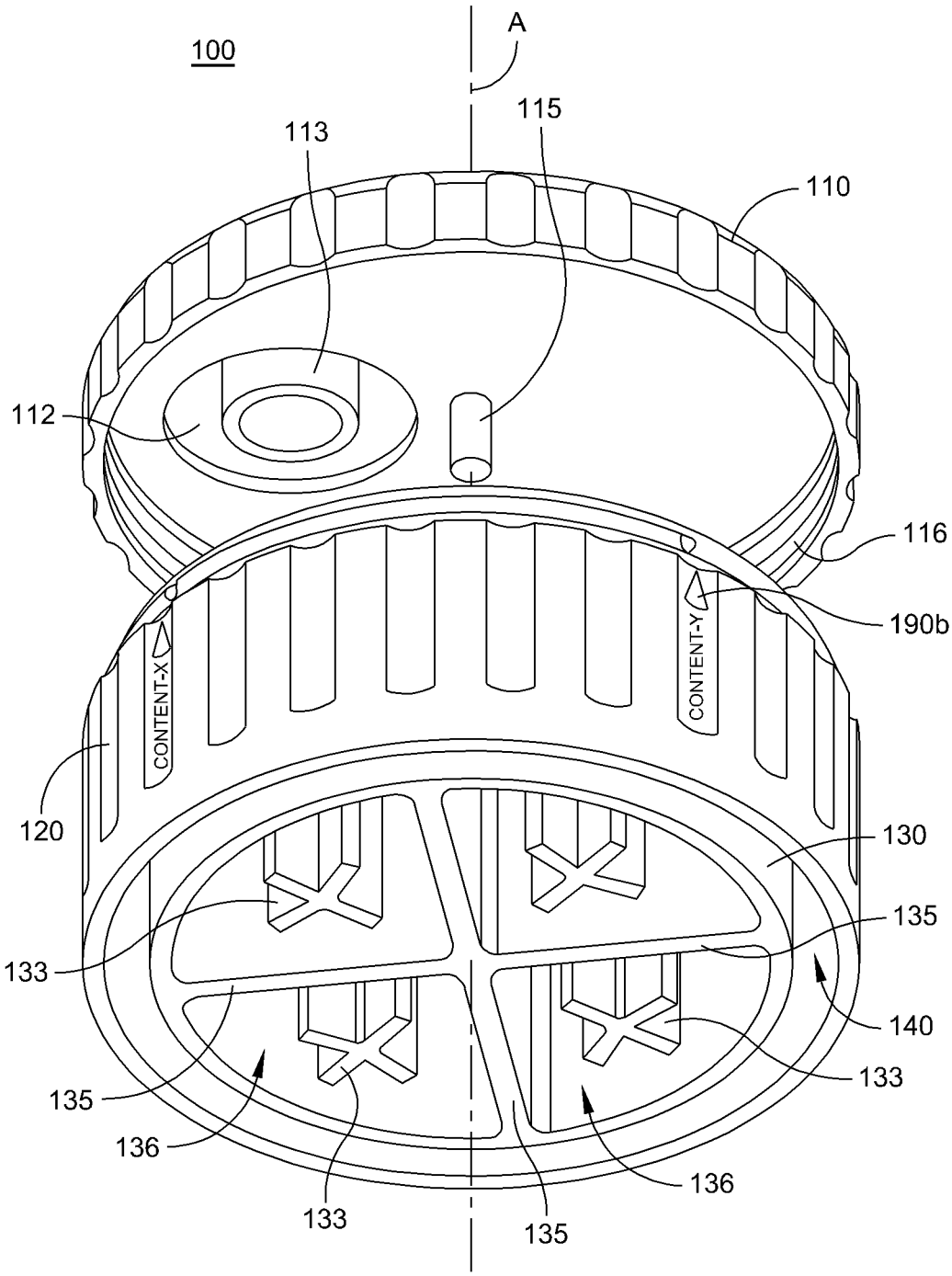
FIG. 4 is an isometric exploded view of the container lid showing the structure of the open bottom end of the main portion.

Referring to FIGS. 2 and 4, the top portion 110 is configured with a substantially vertical annular lip 114 corresponding to the vertical annular wall 124 of the main portion 120. The vertical annular lip 114 of the top portion 110 is configured and adapted for rotatably engaging the vertical annular wall 124. In the illustrated example, the vertical annular lip 114 is provided with a groove 116 along its inner surface that engages the protruding ridge 123 of the main portion 120. The top portion 110 and the main portion 120 are made from a suitable material so that the top portion 110 and the main portion 120 can be snap fitted together by the engagement of the groove 116 and the protruding ridge 123. Once snap fitted together, the top portion 110 and the main portion 120 can be rotated relative to each other about the central axis A while the two portions are held together by the mechanical interference between the groove 116 and the ridge 123. The curvatures of the vertical annular wall 124 and the annular lip 114 are matched to provide smooth rotating motion between the top portion 110 and the main portion 120.

Figure 3:
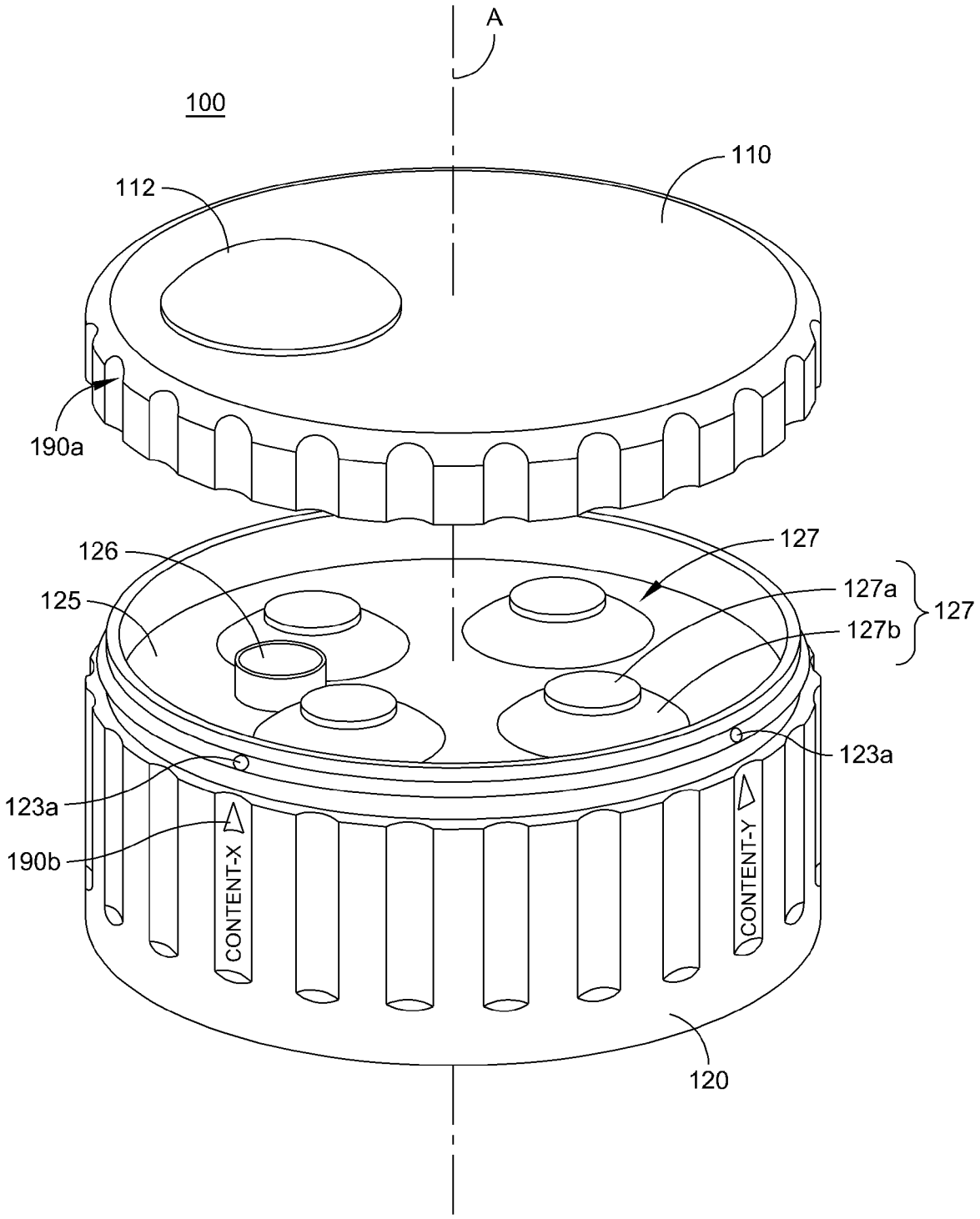
FIG. 3 is an isometric exploded view of the container lid showing the structure of the closed top end of the main portion.

FIGS. 3 and 4 are exploded isometric views of the container lid 100 from two different angles to show the details of the structures. In FIG. 3, the closed top end 125 of the main portion 120 is shown. The main portion 120 is provided with two or more compartments 136 for holding additive substances. The two or more compartments 136 have open bottom ends (see FIG. 4) and closed top ends 127. The closed top ends 127 are connected with the closed top end 125 of the main portion 120. The closed top ends 127 of two or more compartments 136 are visible in FIG. 3. As can be seen, in a preferred embodiment, the closed top ends 127 of the compartments 136 are integrally formed with the closed top end 125 of the main portion 120.

Figure 5:
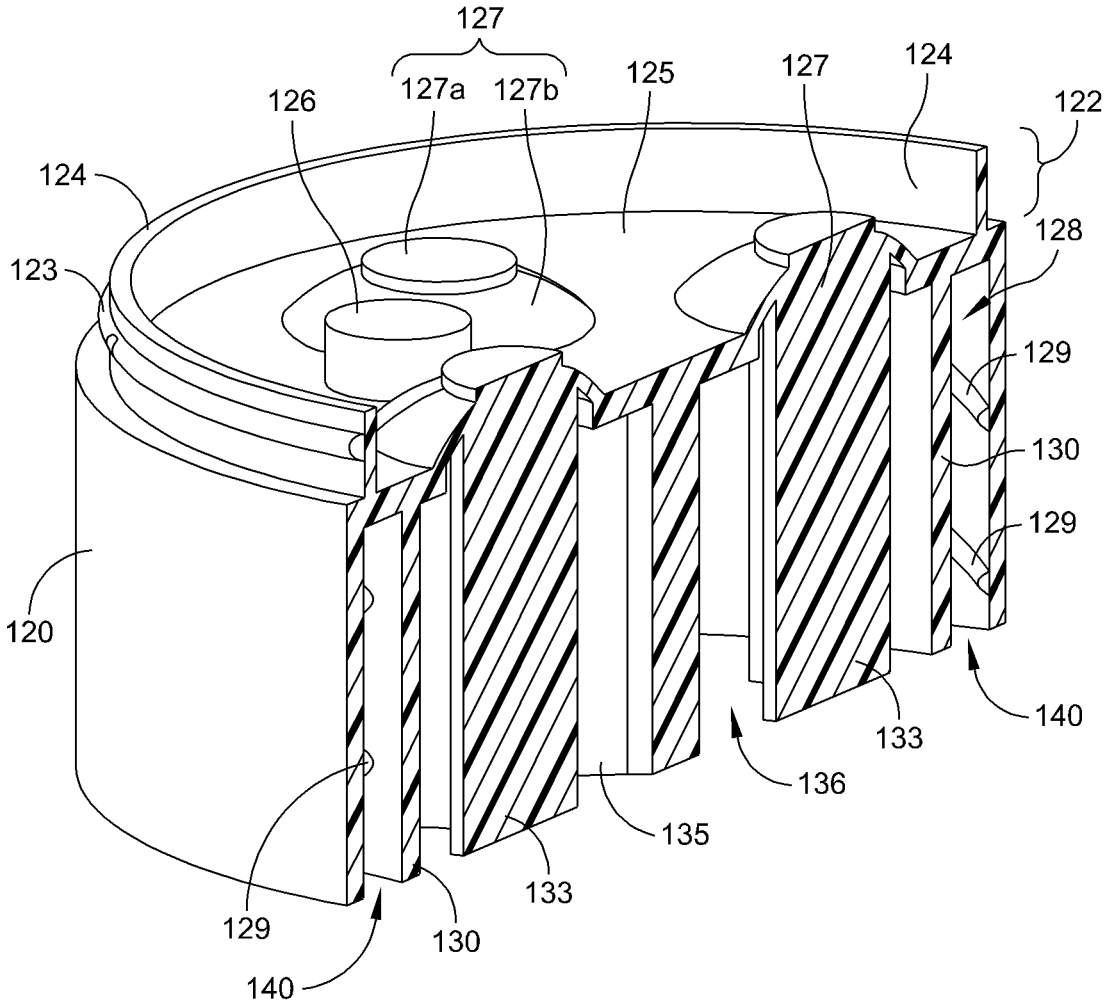
FIG. 5 is a cross-sectional view of the main portion of the container lid showing some of the internal structures of some of the two or more compartments.

Referring to FIGS. 4 and 5, the main portion 120 has an open bottom end. The main portion 120 comprises an inner wall 130 structure that defines a central region separated by a space 140 from the outer wall. The central region defined by the inner wall 130 is divided into the two or more compartments 136 by dividers 135. In the illustrated example, the main portion 120 has four compartments 136 formed by four dividers 135. According to a preferred embodiment, the dividers 135 are arranged in radially symmetrically about the central axis A forming two or more compartments 136 that are equal in size and positioned radially symmetrically about the central axis A. This would allow equal amounts of additive substances to be held in each of the two or more compartments 136.

Provided within each of the two or more compartments 136 is a plunger member 133. As shown in the cross-sectional views in FIGS. 5-6, the plunger members 133 are connected to the closed top ends 127 of the two or more compartments 136. In a preferred embodiment, the top ends 127 of the compartments 136 are integrally formed with the closed top end 125 of the main portion 120. In a preferred embodiment, the plunger members 133 are also integrally formed with the closed top ends 127 of the compartments 136. Thus, the entire main portion 120 can be formed as one integral member by molding the structure in one single mold allowing the main portion 120 to be manufactured by a single molding process. For example, each of the main portion 120 and the top portion 110 are injection molded as integral pieces using an appropriate material such as a polymer material and then assembled together.

Referring to FIG. 4, on the bottom (or the inner) side of the top portion 110, a center support member 115 is provided to provide some structural support in the center region of the top portion 110. The actuator button 112 in this embodiment has a dome-like structure and has a stem 113 about its center on the bottom side. The actuator button 112 is located on the major surface of the top portion 110 off-center. Off-center position refers to the fact that the actuator 112 is located between the central axis A and the periphery of the top portion 110. The actuator 112 and the closed top end 127 of the compartments 136, to which the plunger members 133 are connected, are positioned equidistant in radial direction from the central axis A so that the actuator 112 can be aligned with the plunger member 133 associated with one of the compartments 136 by rotating the top portion 110 to a desired position relative to the main portion 120. Thus, when a particular additive substance being held inside one of the compartments 136 is to be discharged, the user rotates the top portion 110 until the actuator button 112 is aligned with the compartment 136 holding the desired additive substance and depresses the actuator button 112. The stem 113 of the actuator button 112, in turn, pushes down on the closed top end 127 of that particular compartment 136 and pushes the plunger member 133 down from its initial position to actuated position.

Figure 6:
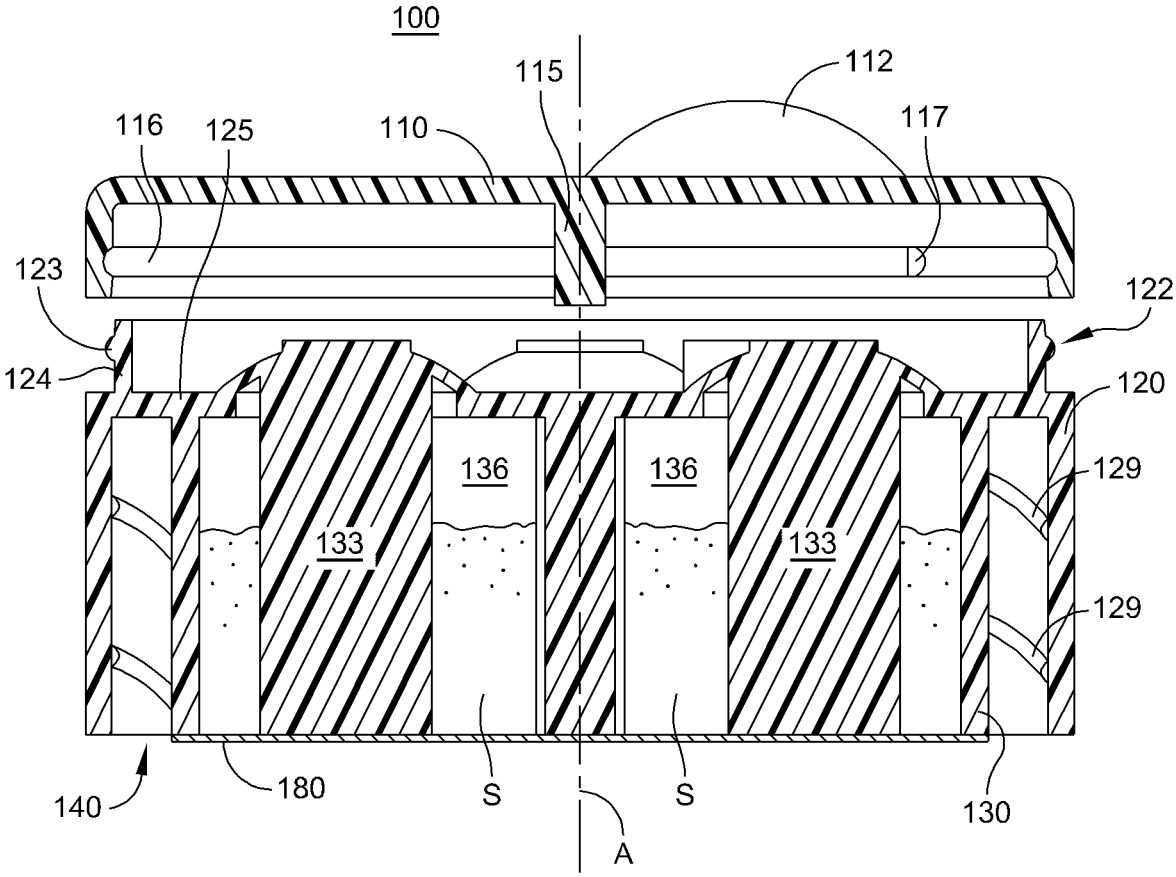
FIG. 6 is a side view cross-section of the top portion and the main portion of the container lid.
Figure 7:
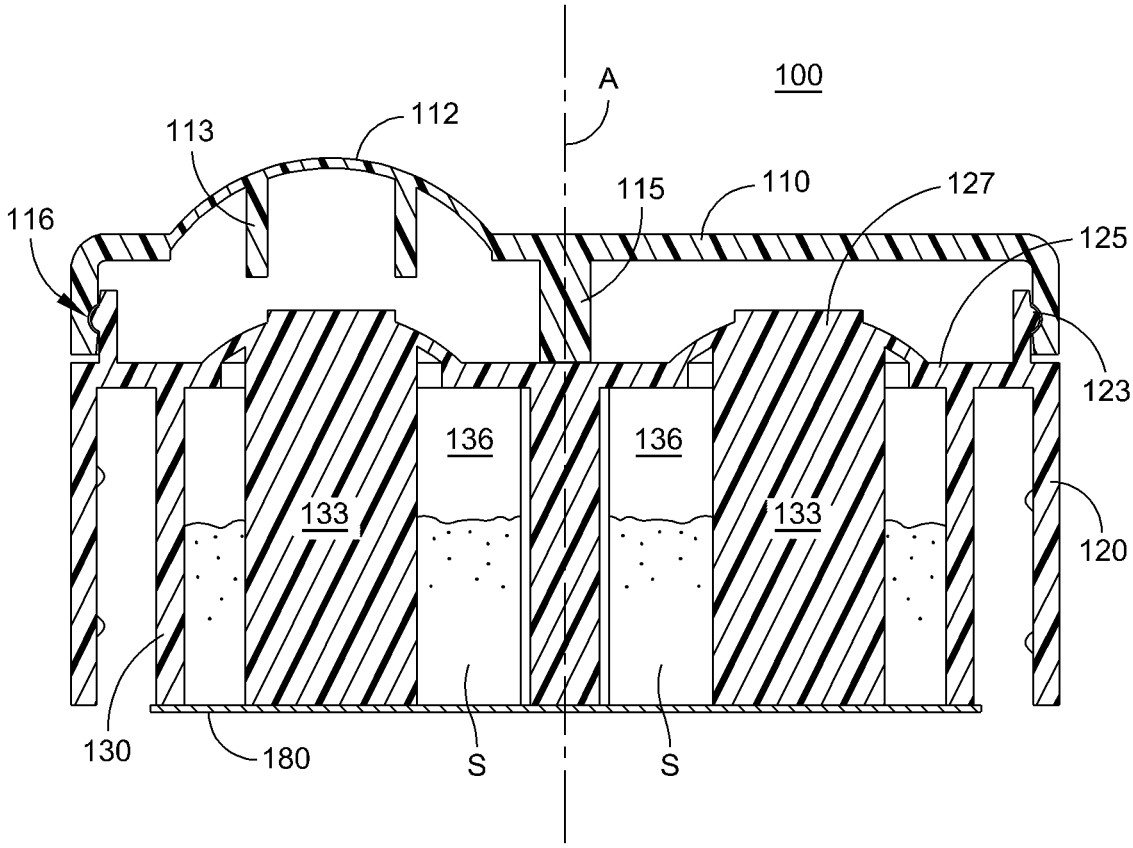
FIG. 7 is a cross-sectional view of the container lid whose two or more compartments are filled with additive substances before the actuator is activated.
Figure 8:
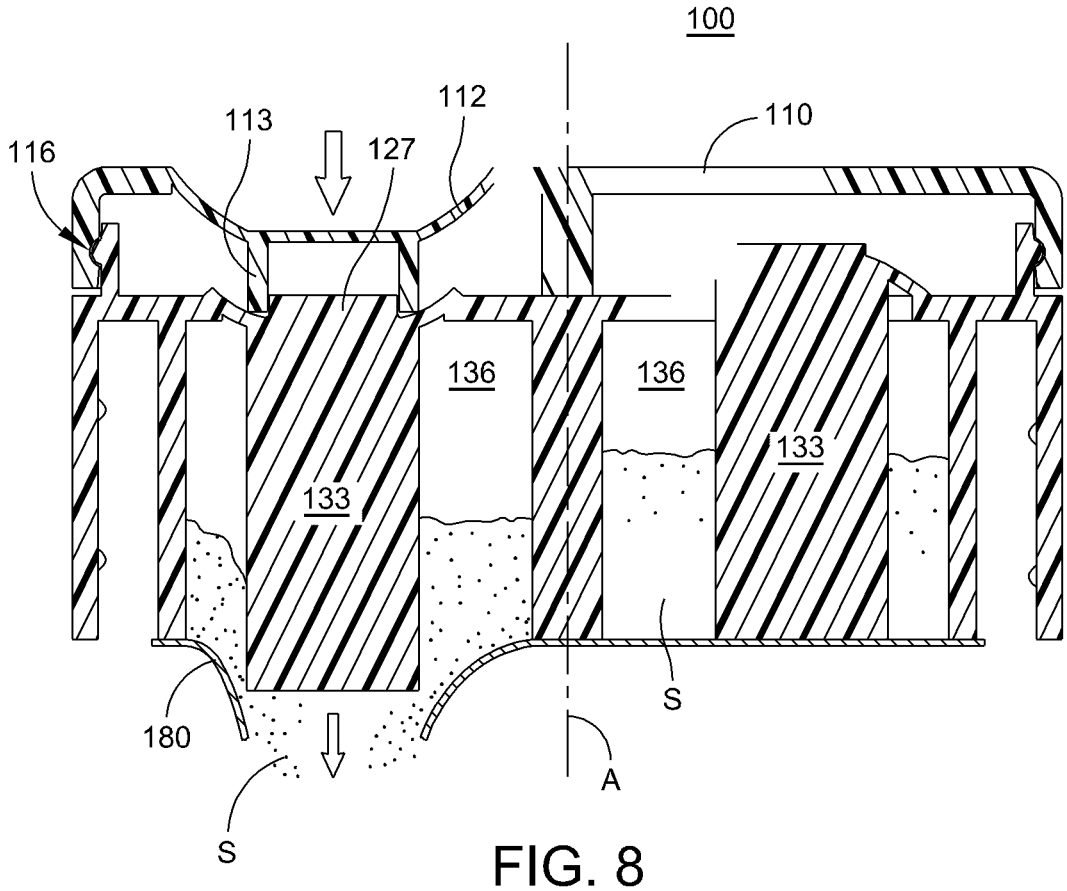
FIG. 8 is a cross-sectional view of the container lid of FIG. 7 after the actuator has been activated.

FIGS. 6 and 7 show the container lid 100 assembly holding additive substances S in the two or more compartments 136. The open bottom ends of the compartments 136 are sealed by a sealing member 180. The actuator button 112 is shown aligned over one of the compartments 136 and still in its initial position. In FIG. 8, the actuator button 112 has been pushed down into its actuated position. The stem 113 of the actuator button 112 has pushed down on the top portion 127 of the compartment and the plunger member 133 has also been pushed down to its activated position. In the activated position, the plunger member 133 extends through the bottom end of the compartment 136 and has broken through the sealing member 180 discharging the content S.

Figure 8A:
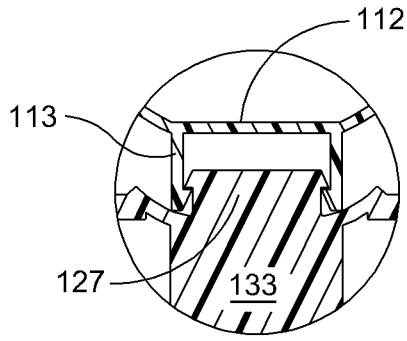
FIG. 8A is a detailed close up view of a portion of the container lid of FIG. 8 according to another embodiment.

In a preferred embodiment, the dome-like structures of the actuator button 112 and the closed top ends 127 of the two or more compartments 136 are structured to function like a bellville washer. This means that once they are pushed down into their actuated positions shown in FIG. 8, the actuator button 112 and the closed top end 127 do not return to their initial positions and remain in the actuated positions. This creates a mechanically locked configuration between the top portion 110 and the main portion 120 and prevents the top portion 110 from being rotated further. FIG. 8A shows an alternate embodiment where the step 113 and the closed top end 127 have interlocking hook structures to keep them locked in the actuated configuration.

The locking embodiment can be utilized in applications where limiting the user from discharging more than one of the additive substances from the container lid 100. If the limitation is not necessary, the actuator button 112 can be structured so that the actuator button 112 returns to its initial position after actuation. This will allow the user to select another of the two or more compartments 136 for actuation and discharge additional additive substances. This may be desired in beverage application where the consumer may elect to make a drink using more than one or all of the flavor additives provided in the container lid 100 assembly.

The sealing member 180 can be a sealing structure that is readily breakable or removed by the downward movement of the actuating plunger member 133. In a preferred embodiment, the sealing member 180 is comprises an appropriately frangible membrane such as a metal foil or a polymer membrane that is bonded to the open bottom ends of the two or more compartments 136. Such membranes can be bonded to the open bottom ends adhesively or by ultrasonic bonding or other suitable bonding methods available to one of ordinary skill in the art. If a metal foil membrane is used for the sealing member 180, the metal foil can be coated with or bonded to a protective layer of polymer material that can prevent the metal from reacting with the contents of the compartment 136. The metal foil embodiment of the frangible membrane can be coined or stamped with an appropriate pattern to facilitate breaking of the membrane by the actuating plunger member 133.

Referring back to FIG. 3, at least one plug or a pedestal structure 126 is provided between two adjacent top ends 127 of the two or more compartments 136 for preventing the actuator button 112 from being accidentally depressed when the top portion 110 is dialed into its "neutral" position where the actuator button 112 and the pedestal structure 126 are aligned. The pedestal structure 126 is sufficiently tall so that it contacts the stem 113 of the actuator button 112 and prevents the actuator 112 from being depressed. Preferably, if the container lid 100 is being shipped with its two or more compartments filled with additive substances and sealed, the top portion 110 is dialed into its "neutral" position to prevent accidental activation of any of the compartments.

Referring to FIGS. 3 and 6, the protruding ridge 123 of the main portion 120 can be provided with a plurality of notches 123*a* and the groove 116 of the top portion 110 can be provided with a bump 117 for assisting the user with the alignment of the actuator button 112 to a desired compartment 136. The bump 117 represents the position of the actuator button 112 and the notches 123*a* represents the locations of the two or more compartments. The bump 117 and the notches 123*a* are positioned such that as the top portion 110 is rotated, when the actuator button 112 comes in alignment with any one of the two or more compartments 136, the bump 117 also comes in alignment with the notch 123*a* that is associated with the particular compartment and provide tactile and/or audible "click" so that the user knows that the actuator button 112 is in alignment with a compartment. For example, in the illustrated embodiment, the bump 117 is in a radial alignment with the actuator button 112 as shown in FIG. 6. The notches 123*a* are in radial alignment with the position of each of the two or more compartments 136 (represented by the closed top ends 127 of the compartments) as shown in FIG. 3. Preferably, visual markings 190*a*, 190*b* can also be provided on the exterior of the top portion 110 and the main portion 120 to aid the user in aligning the actuator button 112. The visual marking 190*a* on the top portion 120 represents the position of the actuator button 112 and the visual markings 190*b* represent the positions of the two or more compartments 136. Alternatively, the main portion 120 can be made from a transparent material so that the two or more compartments 136 and their contents are readily visible to the user to aid in aligning the actuator button 112 with the desired compartment.

Figure 9:
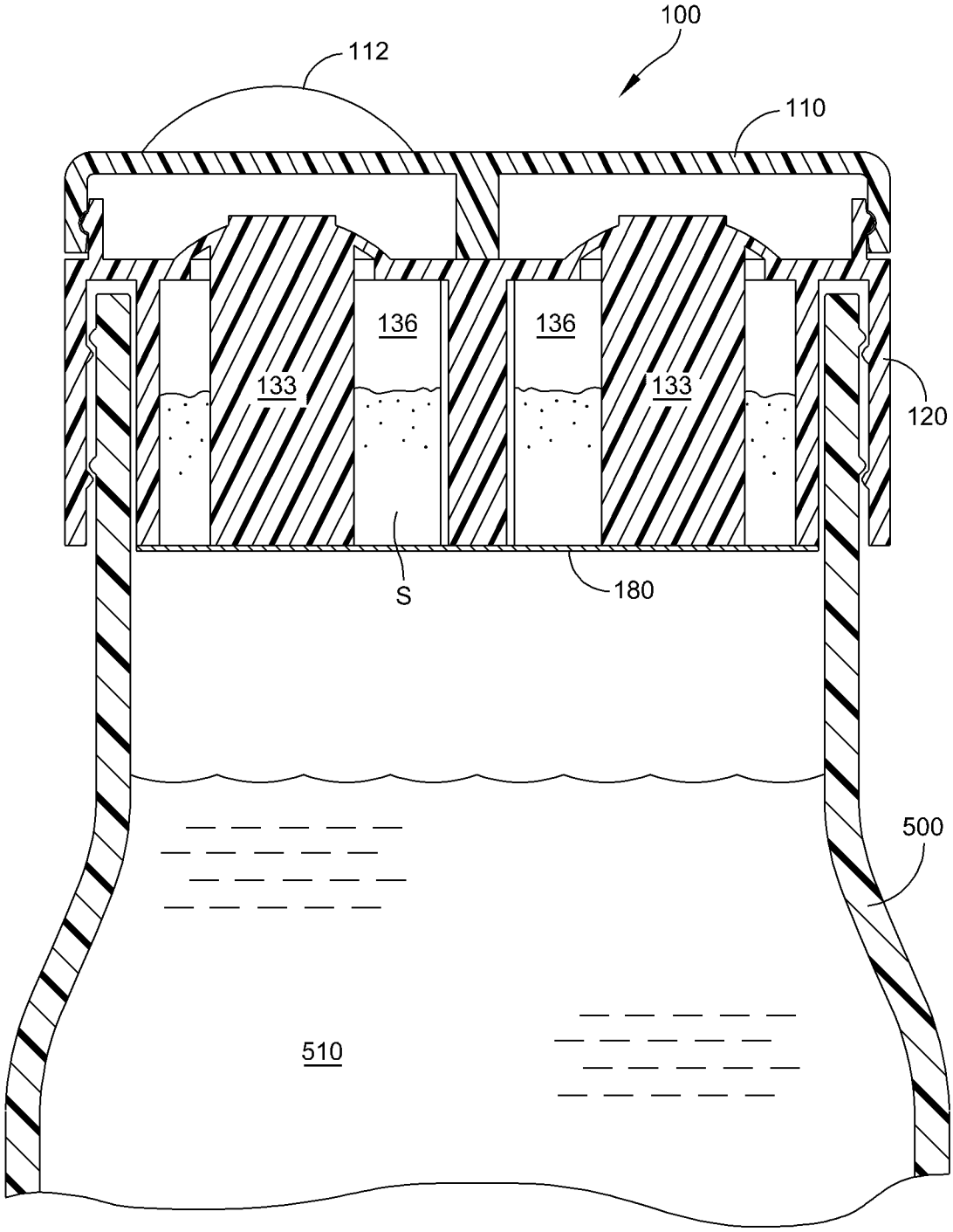
FIG. 9 is a cross-sectional view of the container lid of FIG. 1 mounted onto a water bottle according to an embodiment.

As shown in FIGS. 5 and 6, the main portion 120 is configured and adapted to be attachable to a second container 500. The inner wall 130 defines a space 140 between the inner wall 130 and the inside surface 128 of the outer wall. The space 140 is configured to engage an opening of a vessel 500 such as a water bottle. In the example shown here, the inside surface 128 of the outer wall is provided with screw threads 129 for engaging the threaded opening of the second container 500 commonly found in water bottles and other beverage bottles. FIG. 9 shows such an embodiment of the container lid 100 threaded onto a container 500. The container 500 contains water 510 and the container lid 100 can be filled with various flavoring additives that can be selectively discharged by the consumer to create a desired beverage.

Figure 10:
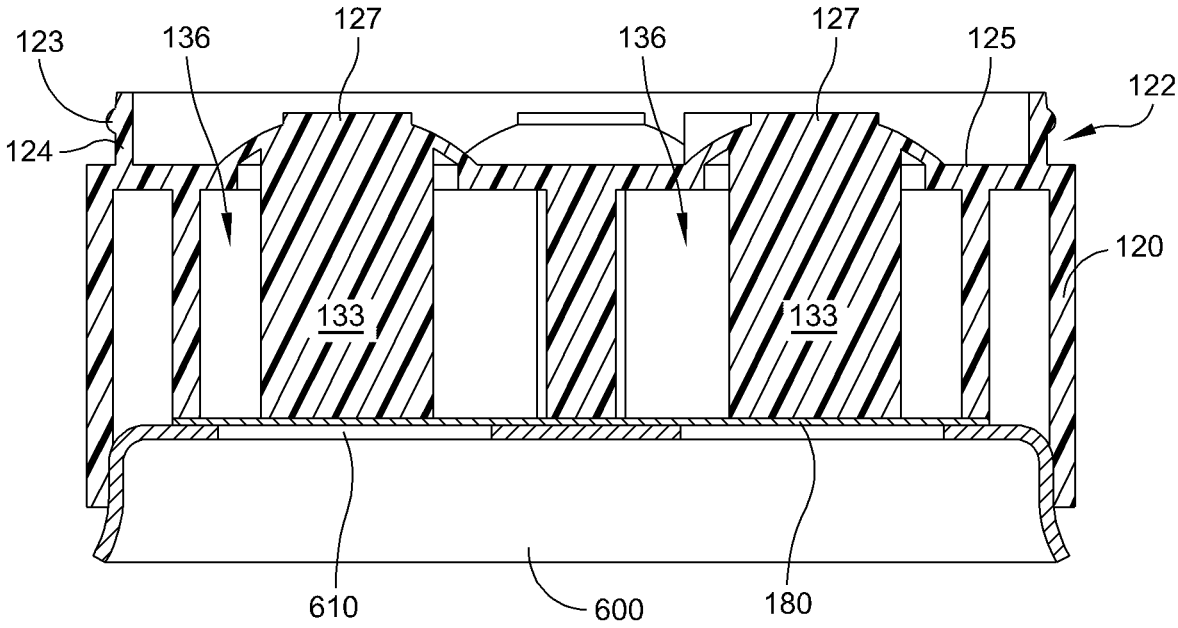
FIG. 10 is a cross-sectional view of the container lid mounted on a metal bottle cap according to another embodiment.

The main portion 120 can be configured and adapted with a variety of different structures for engaging different types of vessel configurations. For example, FIG. 10 shows the container lid 100 assembly mounted to a metal crown bottle cap 600. The metal bottle cap 600 is similar to the metal crown bottle caps commonly found on some beverage bottles but has holes 610 provided therein for accommodating the plunger member 133 and to allow the contents of the container lid 100 to be discharged through the bottle cap 600. The holes 610 allow the plunger member 133 to be pushed through as the plunger breaks through the frangible sealing membrane 180. The container lid 100 assembly with the metal bottle cap 660 attached to the bottom can be used to cap bottles containing the solvent substance. The container lid 100 can be attached to the metal bottle cap 660 by one of a variety of methods available and known to one of ordinary skill in the art.

The various embodiments of the container lid 100 described above can be used in beverage industry, for example, to provide drinks that can be flavored with a desired flavor or fortified with a desired nutritional additive at the time of consumption by the consumer. The container lid 100 can be prefilled and sealed with two or more additives in the two or more compartments. In one embodiment, the container lid 100 can be sold to the consumer directly. The consumer can attach the pre-filled container lid 100 to a bottle of water, for example, and select and discharge the desired additive into the bottle of water just before consumption. The selection and discharge is accomplished by turning the rotatable top portion 110 to the desired compartment and activating that compartment by pushing down on the actuator button 112. In the metal bottle cap embodiment shown in FIG. 10, the soda bottles capped with the metal bottle cap having container lid would be sold to the consumer. The consumer would select the desired flavor for the soda beverage by dialing the rotatable top portion 110 to the desired compartment and activating that compartment.

Figure 11A:
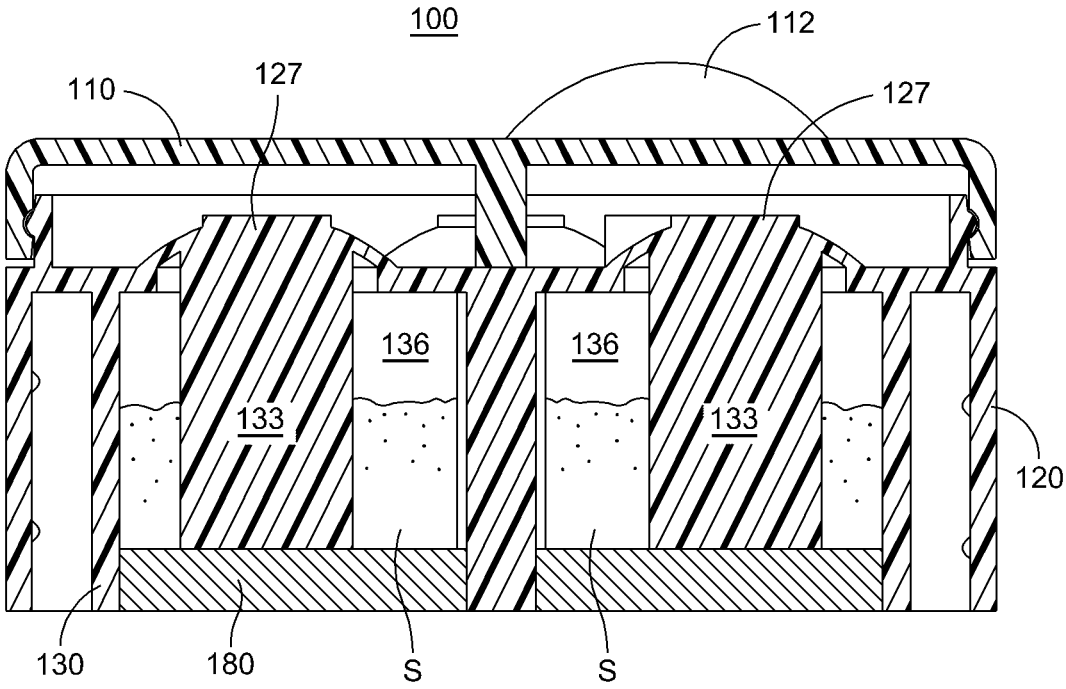
FIG. 11A is a cross-sectional view of the container lid according to another embodiment.
Figure 11B:
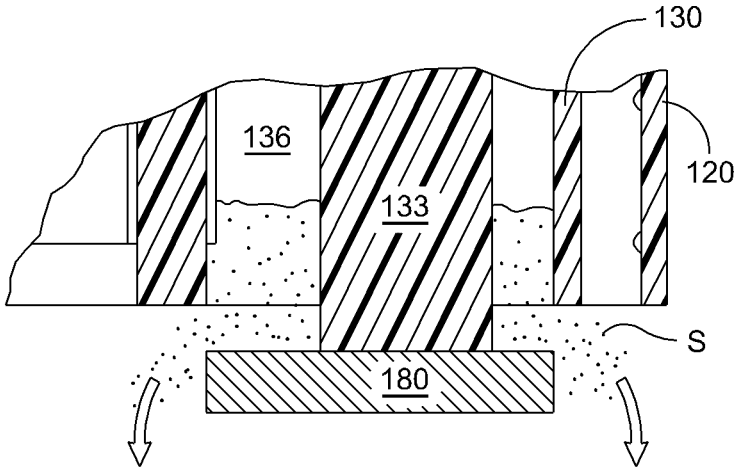
FIG. 11B is a detailed view of the plunger member of the container lid embodiment of FIG. 11A in an actuated position.

Referring to FIGS. 11A and 11B, in another embodiment, the sealing member 180 can be a piston or a plug like structure to which the plunger member 133 is attached as shown. The plunger member 133 and the plug 180 can be attached by an appropriate mechanical fitting configuration for ease of assembly. For example, a hole can be provided on the plug 180 into which the bottom end of the plunger member 133 would be inserted. The dimensions of the hole and the plunger member 133 would be such that the two structure would fit sufficiently snuggly to prevent the plug 180 from falling out. Alternatively the plug 180 and the plunger member 133 can be configured to snap fit into each other. In any event, when the plunger member 133 is activated the plug 180 is pushed down and out of the bottom end of the compartment 136 allowing the content S to be discharged as shown in FIG. 11B. When the plunger member 133 is activated the plunger member 133 pushes the piston 180 down and unseal the compartment 136.

Figure 12:
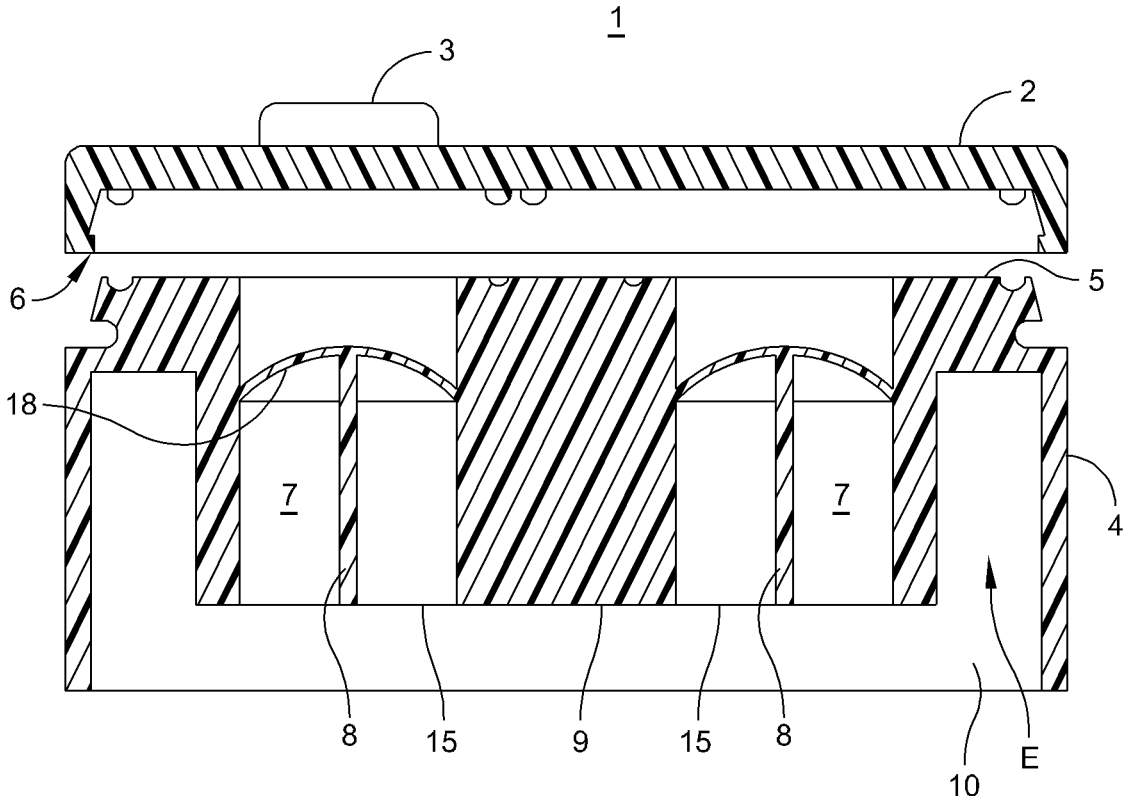
FIG. 12 is cross-sectional view of the container lid embodiment showing the top portion separated from the main portion.

FIGS. 12A-17 disclose additional embodiments according to the present disclosure. FIG. 12 shows a container lid assembly 1 for mixture of substances and comprises a rotatable top portion 2 and a main portion 4. The top portion 2 is provided with an actuator 3. The main portion 4 has a top edge 5 in communication with a bottom edge 6 of the rotatable top portion 2. The main portion 4 is configured with two or more compartments 7 and at least one plunger member 8 provided within each of the compartments 7. The plunger members 8 are configured to be actuated from their initial position to actuated position by means of the actuator 3. The two or more compartments 7 are provided in a central portion 9 of the main portion 4 and are open on the bottom end. The main portion 4 has an outer wall 10 that is separated from the central portion 9 defining a space E between the central portion 9 and the outer wall 10. The outer wall 10 and the central portion 9 defining the space E can be configured and adapted for engaging an opening of another container such as the bottle 500 in the embodiment shown in FIG. 7.

Figure 15:
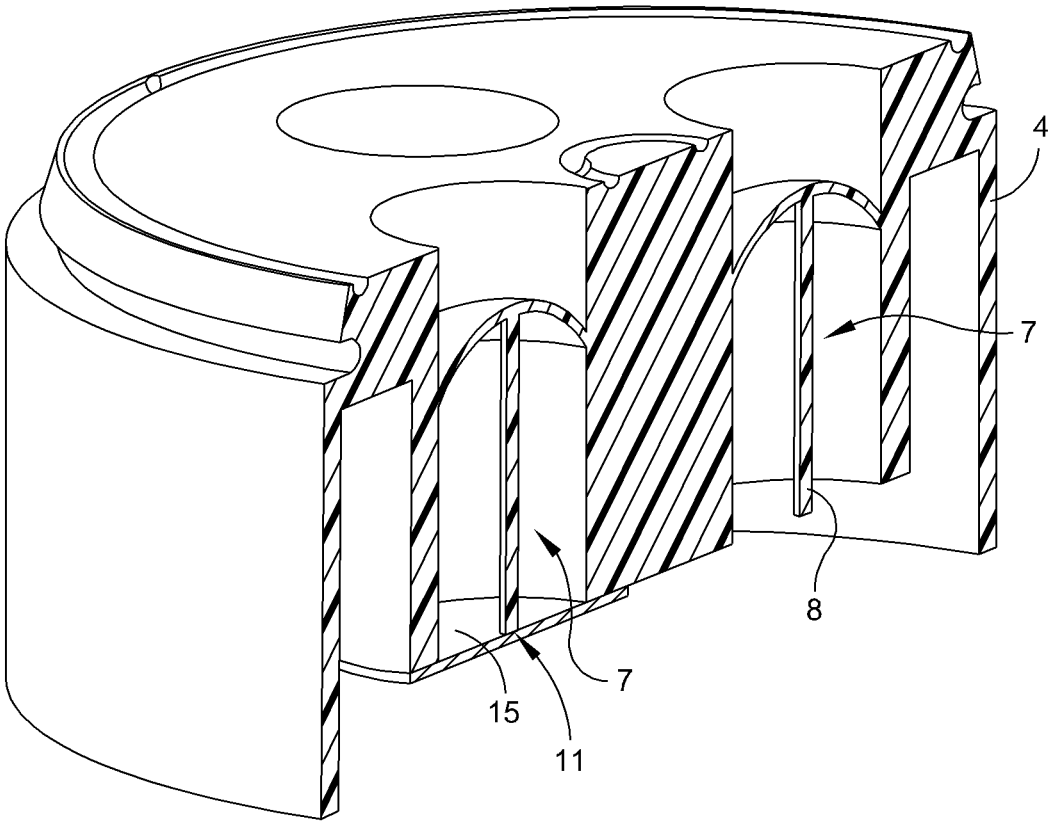
FIG. 15 is an isometric cross-sectional view of the main portion of the container lid according to one embodiment.

The container lid assembly 1 can be permanently affixed or removably attachable to a container. In operation, the bottom portion 4 of the container lid assembly 1 can be attached to a container, such as a beverage bottle, by any means known in the industry, including but not limited to threading, swaging or clamping. Subsequently, the rotatable top portion 2 is rotated into position until the actuator 3 is aligned with one of the two or more compartments 7. Then, when the actuator 3 is depressed, the plunger member 8 is in turn depressed into its actuated position. Each of the two or more compartments 7 has a closed top end 18 that is integrally formed with the main portion 4. The plunger member 8 is connected to the closed top end 18 and preferably also integrally formed with the closed top end 18. The arcuate bellville washer like configuration of the closed top end 18 functions to lock the plunger member 8 in the pushed-down actuated position upon activation of the plunger member using the actuator 3. The open bottom ends of the compartments 7 can be sealed with a sealing member 15 after component substances are placed in the compartments 7. In one preferred embodiment, the sealing member 15 is a frangible membrane that is broken open by the plunger member 8, such as a metal foil, upon activation of the plunger member 8. In FIG. 15, the compartment 7 on the left side of the figure is shown with a sealing member 15 sealing the open bottom end of the compartment. The sealing member 15 can be made of penetrable membrane such as a foil membrane or any other kind of material which is easily penetrable by the plunger member 8.

Figure 13:
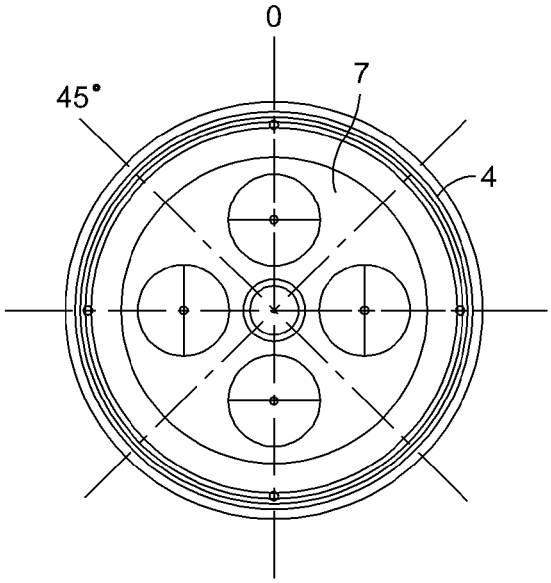
FIG. 13 is a top view of the main portion of the container lid of the present disclosure showing the radially symmetric positions of the two or more internal compartments and the associated plunger members.
Figure 14:
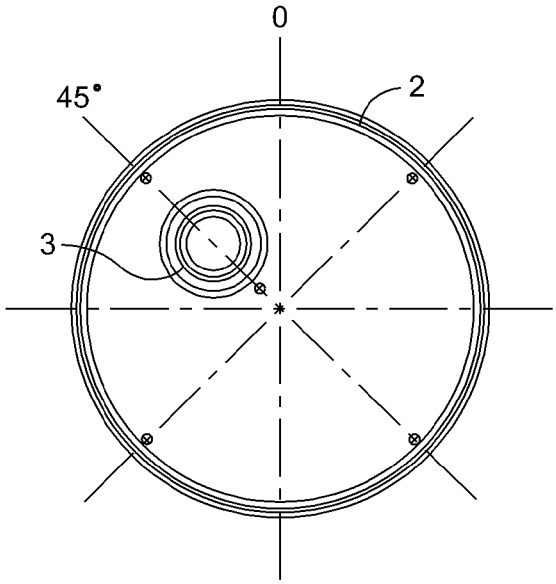
FIG. 14 is a top view of the top portion of the container lid of the present disclosure showing the off-center position of the actuator button.

FIGS. 13 and 14 shows top-down views of the main portion 4 and the top portion 2. In this illustrated example, the main portion 4 is provided with four compartments 7 arranged in radially symmetric manner so that the main portion 4 is divided into four quadrants, each quadrant being one of the two or more compartments 7.

In one embodiment of the container lid 1, the plunger mechanism 8 may contain a serrated edge 11 to facilitate breaking through the sealing member 15. In this configuration, once the actuator 3 is depressed, the plunger member 8 breaches the penetrable sealing member 15, allowing the contents of the compartment 7 to be discharged.

Figure 16:
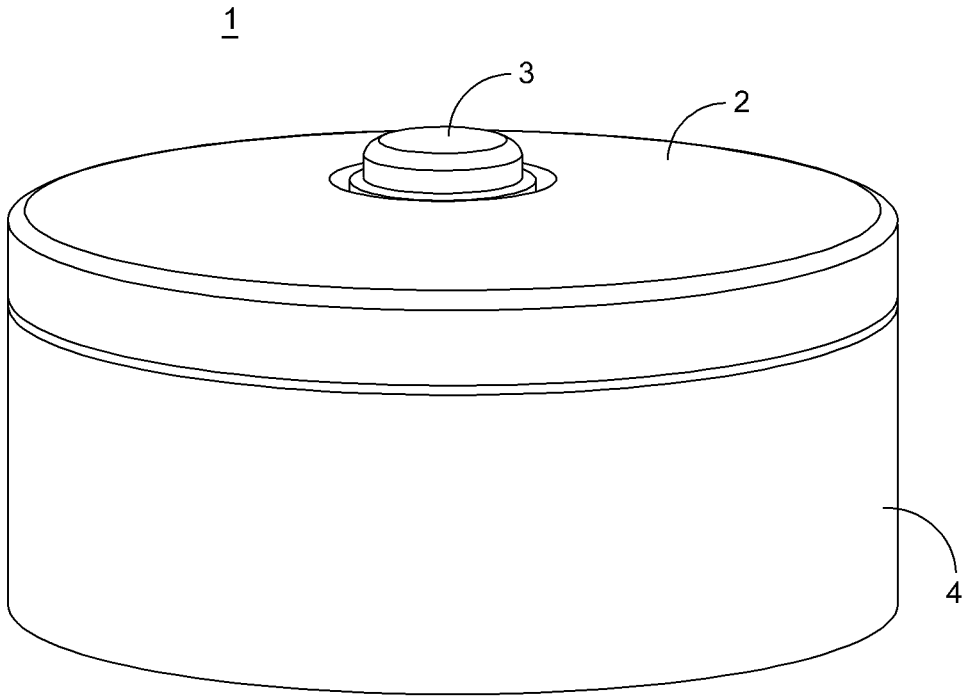
FIG. 16 is an isometric view of the container lid assembly of FIG. 12.

FIG. 16 shows an isomeric view of the container lid assembly 1 showing the top portion 2 and the main portion 4 rotatably engaged to each other.

Figure 17:
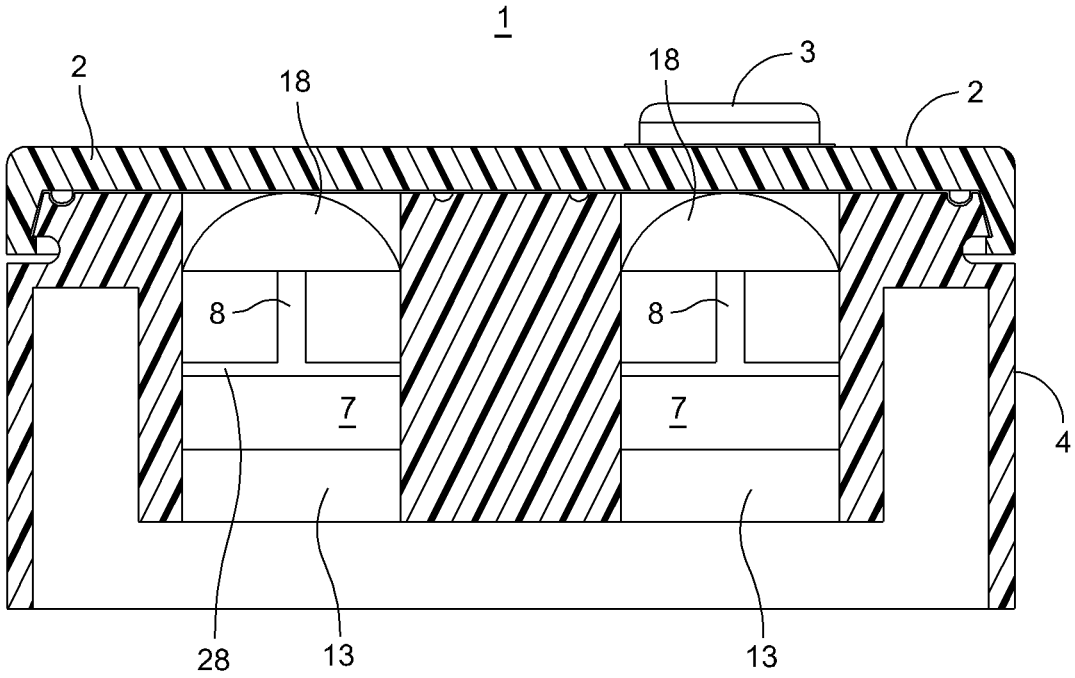
FIG. 17 is a cross-sectional view of the container lid assembly of the present disclosure according to another embodiment.

Referring to FIG. 17, in a further embodiment of the lid container, the open bottom end of the two or more compartments 7 can be sealed by unidirectional flow valves 13. The bottom ends of the plunger member 8 are configured as pistons 28 and upon depression of the actuator 3 aligned over one of the two or more compartments 7, the plunger mechanism 8 and the piston 28 in that particular compartment moves downward and forces the contents of the compartment 7 out through the unidirectional flow valve 13. In such embodiment, the contents of the compartments 7 would preferably be liquid substance. The unidirectional flow valve 13 may comprise a check valve or a tensioned flap.

As discussed above in connection with other embodiments, the actuator 3 and the closed top ends 18 of the two or more compartments 7 can be configured and adapted to lock the actuator 3 to the closed top ends 18, and in turn to the plunger member 8, upon activation of the actuator over one of the compartments 7. Such locking configuration can be achieved by a permanent detent or other such mechanism as known in the art, such that upon activation, the locking mechanism 15 permanently secures the actuator 3 to the plunger. This locking mechanism serves to lock the actuator 3 and the plunger member 8 in actuated position and consequently, prevent the user from activating any of the other remaining compartments. In chemical solution mixing application, this feature ensures the integrity of the mixed solution, preventing over mixing and ensuring that the container lid assembly 1 is not readily reused.

Figure 18:
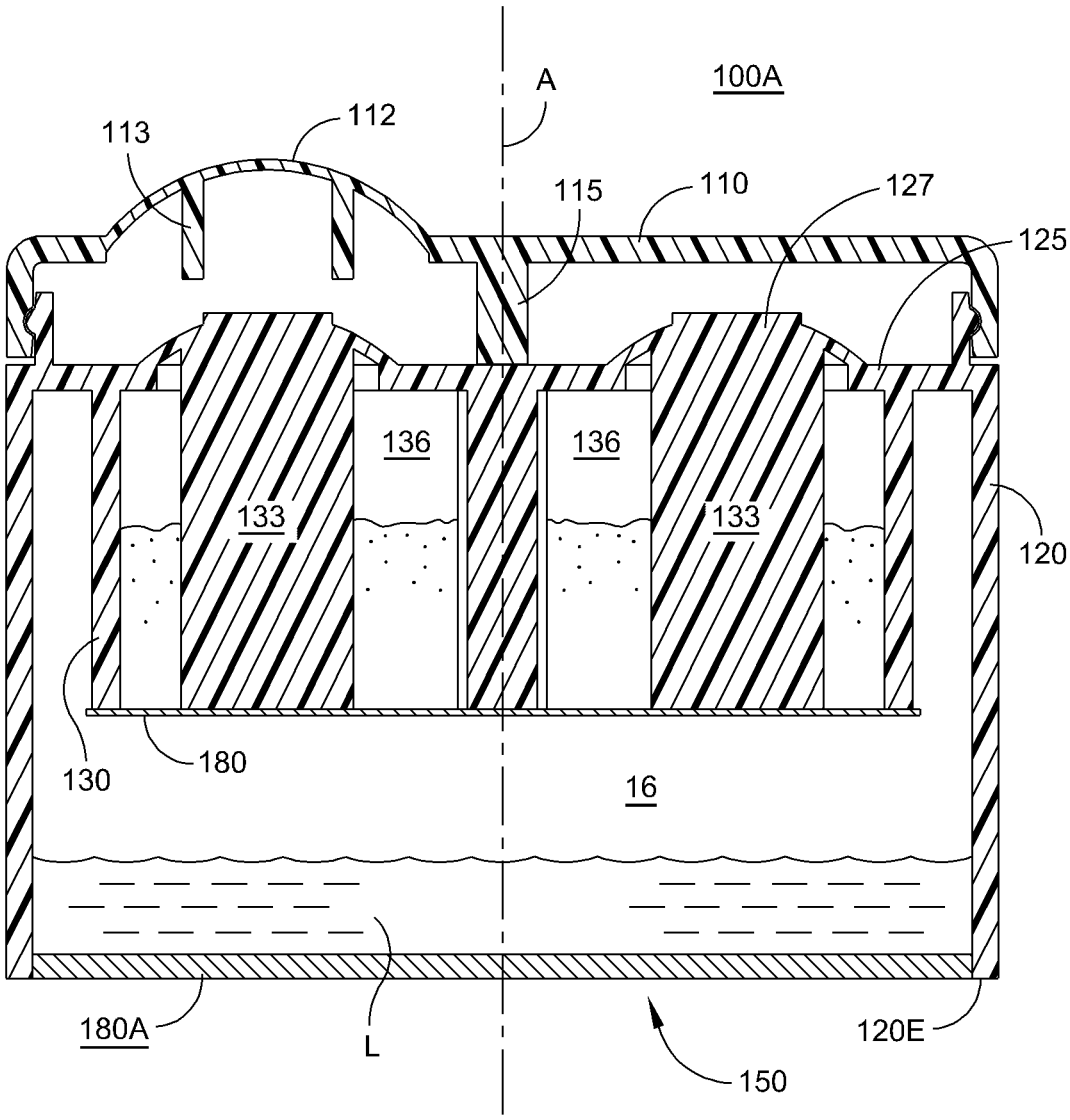
FIG. 18 is a cross-sectional view of the container lid assembly of the present disclosure according to yet another embodiment.

Referring to FIG. 18, the principles of the container lids 1 and 100 discussed above can be adapted to a container having a main compartment holding a primary substance and two or more sub-compartments for holding additive substances that can be selectively discharged to make a mixture or solution with the primary substance. FIG. 18 shows a container 100A that has structures similar to the container lid 100 shown in FIG. 7. In the container 100A, the outer wall of the main portion 120 extends further downward forming a bottom opening 150 defined by the bottom edge 120E of the outer wall of the main portion 120. When the bottom opening 150 is sealed by a second sealing member 180A as shown, a main compartment space 16 is formed. A primary substance such as a liquid L can be placed into this main compartment space 16 before the second sealing member 180A is placed in position. Similar to the first sealing member 180, the second sealing member 180A can be formed from the same selection of materials. For example, the second sealing member 180A can be breakable membrane or a solid plug that can be threaded onto the outer wall of the main portion 120 or bonded to the main portion 120 in one of a variety of ways known in this art.

Furthermore, in another embodiment, the main compartment 16 can be configured into additional compartments by one or more dividers. Within each of these subdivided main compartments, two or more compartments 136 can be provided.

Figure 19:
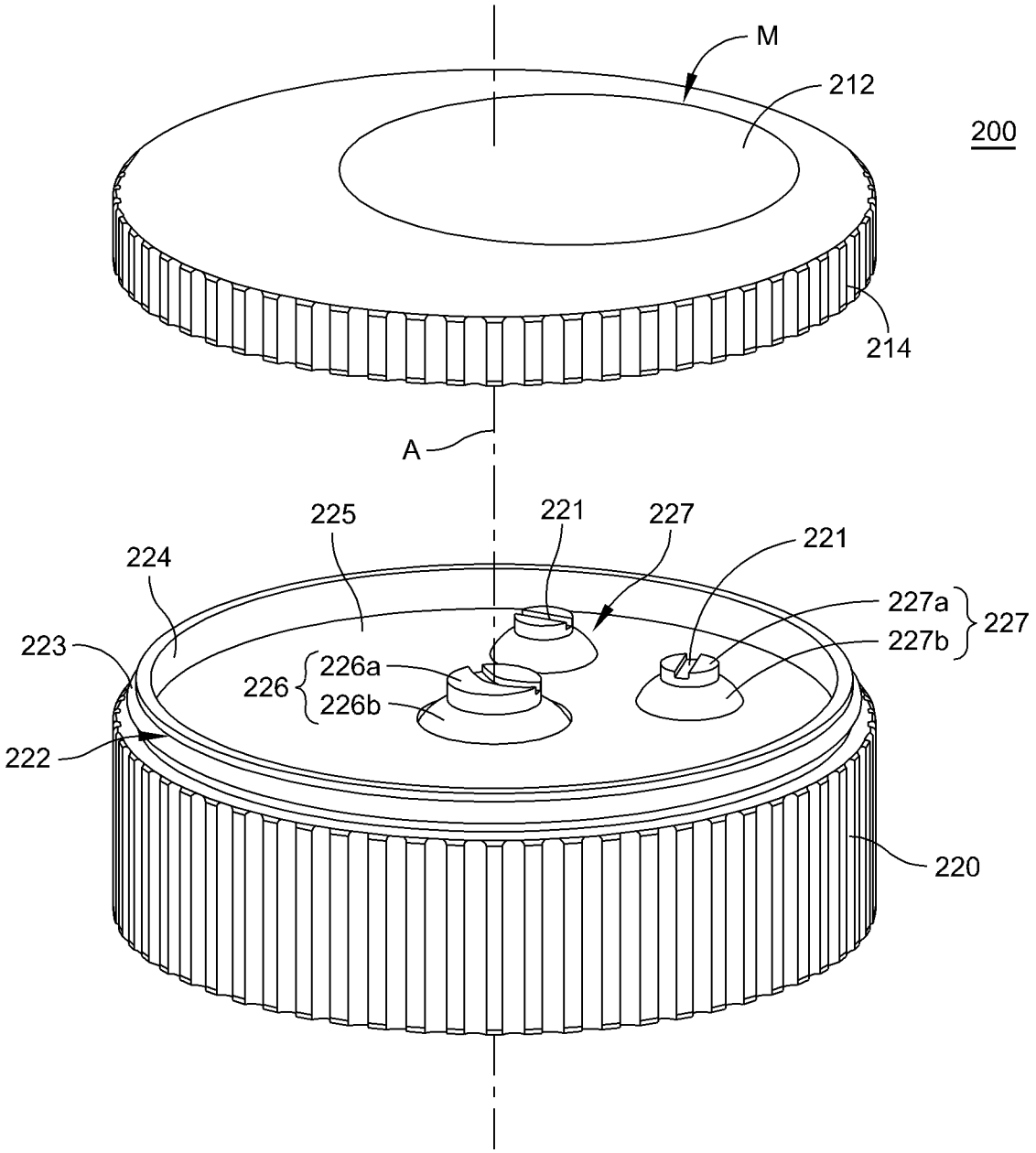
FIG. 19 is an isometric exploded view of the container lid assembly according to another embodiment showing the structure of the closed top end of the main portion.
Figure 20:
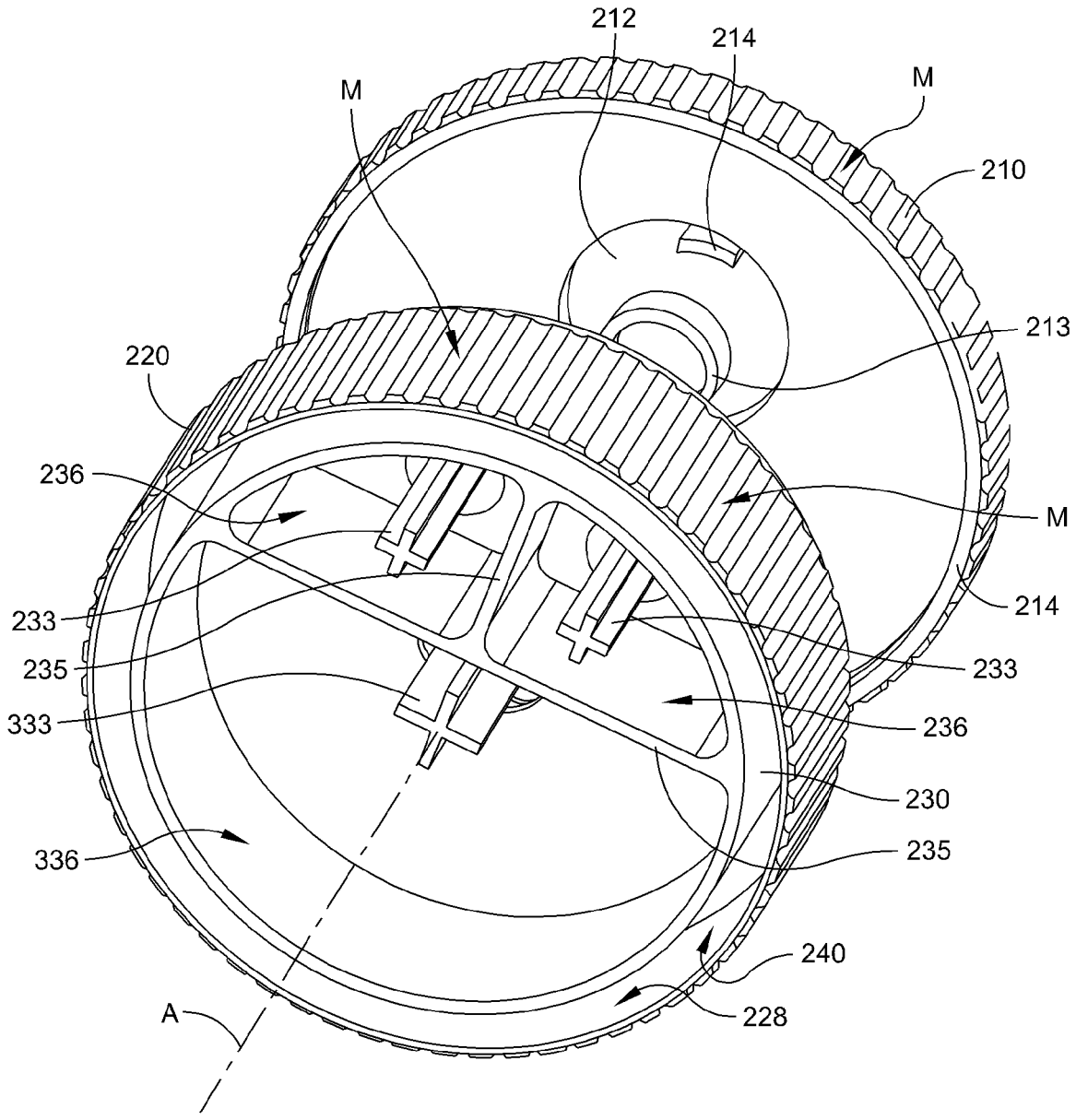
FIG. 20 is an isometric exploded view of the container lid assembly of FIG. 19 showing the structure of the open bottom end of the main portion.

Referring to FIGS. 19 and 20, a container lid 200 for mixture of two or more substances to be selectively discharged into a container according to another embodiment is described. The container lid 200 is configured to have internal compartments 236, 336 that are provided in non-radially symmetric arrangement. The container lid 200 comprises a top portion 210 and a main portion 210. An actuator 212 for actuating the container lid 200 is provided on the top portion 210. Similar to the container lid embodiment 100, the top portion 210 and the main portion 220 are configured and adapted to be rotatably connected so that the top portion 210 and the main portion 220 are rotatable relative to each other about the central axis A of the container lid 200. The top peripheral region 222 of the main portion 220 is configured and adapted for rotatably engaging the top portion 210 in the manner similar to the top peripheral region 122 of the container lid 100. The top peripheral region 222 comprises a substantially vertical annular wall portion 224. The vertical annular wall portion 224 is provided with a protruding ridge 223 that circumscribes the outer surface of the vertical annular wall 224.

The top portion 210 is configured with a substantially vertical annular lip 214 that corresponds to the vertical annular wall 224 of the main portion 220. The vertical annular lip 214 can be configured and adapted for rotatably engaging the vertical annular wall 224 in the similar manner as the vertical annular lip 114 and the vertical annular wall 124 of the container lid embodiment 100.

The top portion 210 and the main portion 220 are made from a suitable material so that the top portion 210 and the main portion 220 can be snap fitted together. Once snap fitted together, the top portion 210 and the main portion 220 can be rotated relative to each other about the central axis A.

FIG. 19 shows the closed top end 225 of the main portion 220 and FIG. 20 shows the internal structure of the main portion 220. The main portion 220 comprises an inner wall structure 230 that defines a central region separated by a space 240 from the outer wall surface 228. The central region is divided into one major compartment 336 and two or more minor compartments 236 by dividers 235. The major and minor compartments have open bottom ends and closed top ends as shown. The closed top ends are integrally formed of the closed top end 225 of the main portion 220. In this embodiment, the major compartment 336 is larger than the two or more minor compartments 236.

In the illustrated example, the three compartments, two minor compartments 236 and one major compartment 336, are defined by the dividers 235. The major compartment 336 would be used for holding a major additive substance and the two or more minor compartments 236 would be used for holding various minor additive substances that are required in lesser quantity than the major additive substance. The number and size of the minor compartments 236 is configured according to the number of minor additive substances and amount of each of the minor additive substances that are desired.

Provided within each of the two or more minor compartments 236 is a plunger member 233. Each of the plunger members 233 are integrally connected to the closed top end 225 of the main portion 220 and form a depressible button 227 that protrude out of the closed top end 225 as shown in FIG. 19. In a preferred embodiment, the depressible buttons 227 are integrally formed with the closed top end 225 of the main portion 220 and comprises a center portion 227*a* and a flexible bellville washer-like portion 227*b*. The flexible portion 227*b* allows the center portion 227*a* to be pressed downward which in turn moves the plunger member 233 down similar to the plunger members 133 and 8 discussed in connection with other embodiments above.

Provided within the major compartment 336 is a plunger member 333 that is integrally connected to the closed top end 225 of the main portion 20 and form a depressible button 226 that protrude out of the closed top end 225 as shown in FIG. 19. In a preferred embodiment, the plunger member 333 and in turn the corresponding depressible button 226 is located at the center of the main portion 220 in alignment with the central axis A of the container lid 200.

The depressible button 226 is integrally formed with the closed top end 225 of the main portion 220 and comprises a center portion 226*a* and a flexible bellville washer-like portion 226*b*. The flexible portion 226*b* allows the center portion 226*a* to be pressed downward which in turn moves the plunger member 333 downward similar to the plunger members 133, 8 and 233. The main portion 220 can be formed as one integral member including the plunger members 233 and 333 similar to the main portion 120 of the container lid embodiment 100.

The actuator 212 in this embodiment has a flexible dome-like structure and has a major stem 213 for engaging and actuating the depressible button 226 of the major compartment 336 and a minor stem 214 for actuating the depressible button 227 of two or more minor compartments 236. The actuator 212 is also provided with a minor stem 214 located off-center on the bottom side of the top portion 210 for engaging and actuating the depressible button 227 as shown in FIG. 20. The minor stem 214 is located off-center so that it can be brought into alignment with the off-center positioned depressible buttons 227.

In one embodiment, the actuator 212 itself is also located off-center on the top portion as shown to encompass both the major and minor stems 213, 214 on the bottom side of the actuator 212. However, the actuator 212 can also encompass the whole top surface of the top portion 210 as long as the location of the major stem 213 and the off-centered location of the minor stem 214 are marked appropriately on the actuator 212 so that the user knows where to press down to actuate the plunger members 233, 333.

When the top portion 210 is assembled with the main portion 220, the centrally located major stem 213 is in alignment with the depressible button 226 of the major compartment 336. The off-centered minor stem 214 and the two or more depressible buttons 227 are located equidistant from the central axis A such that the minor stem 214 and the two or more depressible buttons 227 can be brought into alignment by rotating the top portion 210 about the central axis A.

Figure 21:
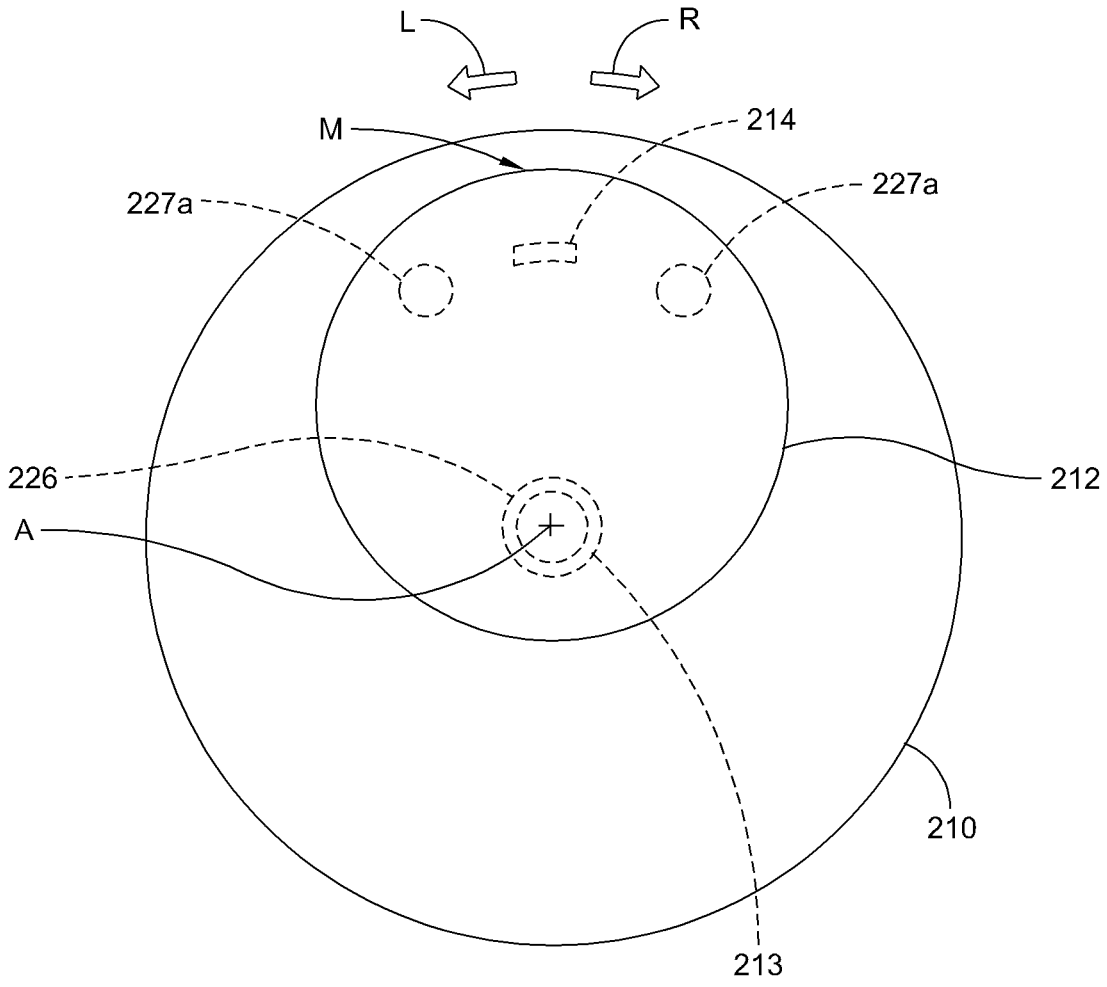
FIG. 21 is a top-down view of the container lid 200 of FIG. 19.

A top-down view of an assembled container lid 200 in FIG. 21 illustrates the arrangement of the major and minor stems 213, 214 with respect to the depressible buttons 226, 227 in detail. The major stem 213, minor stem 214 and the center portions 227*a* of the depressible button 227 are shown in broken lines. The major stem 213 is provided at or near the center of the top portion 210. The center of the top portion 210 being identified by the central axis A. The minor stem 214 is positioned so that by turning the top portion 210 in the direction L or R marked by the arrows, the minor stem 214 is brought in alignment with the center portions 227*a* of the depressible buttons 227. As shown in FIGS. 19-21, the top portion 210 and the main portion 220 can be provided with appropriate alignment markings M to enable the user to know when the minor stem 214 is in alignment with the depressible button 227 for the desired minor compartment 236.

After the top portion 210 is dialed into a desired position, the contents of the major compartment 336 and one of the minor compartment 236 are discharged by pressing down on the actuator 212. The actuator 212 can be configured to be sufficiently rigid so that by pressing down anywhere on the actuator 212 will push both the major stem 213 and the minor stem 214 down into the corresponding depressible buttons 226, 227 which in turn push the plunger members 333, 233 downward from their initial position into their actuated position and break the sealing member at the bottom ends of the compartments 336, 236. Alternatively, the actuator 212 can be configured to be more flexible so that each of the major compartment 336 and the selected one of the two or more minor compartments 236 can be unsealed one at a time. This can be achieved by the user pressing down in to the appropriate portion of the actuator 212 corresponding to the locations of the major stem 213 and the minor stem 214 thus actuating the corresponding plunger members individually.

The center portions 227*a* can be provided with slots 221 for engaging the minor stem 214. Because the major stem 213 is centrally located on the top portion 210, as the top portion 210 is rotated about the central axis A, the major stem 213 remains in alignment with the depressible button 226 which is also centrally located on the main portion 220.

Similar to the container lid embodiment 100 discussed above, in one preferred embodiment, the bellville washer-like portions 226*b*, 227*b* of the depressible buttons 226, 227 functions to lock the corresponding plunger members 333, 233 in their pushed-down actuated position upon activation of the plunger members.

Similar to the container lid embodiment 100 discussed above, the open bottom ends of the major and minor compartments 336, 236 can be sealed by a sealing member to hold the additive substances placed inside the major and minor compartments 336, 236. When the plunger members 233, 333 are urged downward by pressing down the actuator 212, the plunger members 233, 333 break the sealing member allowing the contents of the corresponding compartments to be discharged. Additionally, similar to the container lid embodiment 100A shown in FIG. 18, the container lid embodiment 200 also can utilize a second sealing member (see 180A of FIG. 18) to close the open bottom end of the main portion 220 and define a main compartment.

The instant invention can easily be molded with current tooling technology. Existing bottle designs can be used with no modifications bottle can be easily recycled it will have no contaminants molded into it environmentally friendly. The container lids disclosed herein can be manufactured from several materials including but not limited to polymers, composites and flexible metal alloys.

As to a further discussion of the manner of usage and operation of the present invention, the same should be apparent from the above description. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Although the invention has been described using few example embodiments, the scope of the invention described herein is to be defined and limited only by the appended claims and include other variants and embodiments of the invention, which may be made by those skilled in the art without departing from the scope and range of equivalents of the invention.

What is claimed is:

1. A container lid for mixture of two or more substances comprising:

a top portion provided with an actuator; and a main portion comprising:

a closed top end, open bottom end and a central axis, said closed top end operably connected to said top portion;

three or more compartments having closed top ends and open bottom ends, wherein said closed top ends of the three or more compartments are incorporated into the closed top end of the main portion of the container lid; and a plunger member provided within each of said three or more compartments, said plunger members connected to the closed top ends of the three or more compartments;

wherein the top portion and the main portion are rotatably attached to each other and rotatable about said central axis, wherein one of the three or more compartments is a major compartment that is larger than the other of the three or more compartments;

wherein said plunger member of said major compartment is located in alignment with said central axis of the main portion and said actuator is always in alignment with the plunger member of said major compartment and the actuator is provided with a major stem for engaging and actuating the plunger member of the major compartment and a minor stem for actuating the plunger member of the other of the three or more compartments, wherein the minor stem is located off-center on the actuator whereby the minor stem is aligned with the plunger member of the other of the three or more compartments by rotating the top portion about said central axis, and the top portion and the main portion are configured with one or more tactile and/or audible indicators for indicating alignment between the actuator's minor stem and one of the two or more compartments.

2. The container lid of claim 1, wherein said plunger members are integrally connected to the closed top ends of the three or more compartments.

3. The container lid of claim 1, wherein the plunger members of said other of the three or more compartments are equidistant in radial direction from the central axis.

4. The container lid of claim 1, wherein said closed top ends of the three or more compartments are integrally formed into the closed top end of the main portion of the container lid.

5. The container lid of claim 1, wherein said plunger members are movable from an initial position to an actuated position and a particular plunger member is moved to the actuated position by aligning the actuator to the compartment associated with said particular plunger member and pushing down on the actuator.

6. The container lid of claim 5, wherein said plunger members are configured to be locked in said actuated position once actuated.

7. The container lid of claim 6, wherein said closed top ends of the three or more compartments are configured as a bellville washer like structure to which said plunger members are centrally connected, wherein said bellville washer like structure allows the plunger members to be locked in the actuated position.

8. The container lid of claim 7, wherein said plunger members are integrally formed into the closed top ends of the compartments.

9. The container lid of claim 1, wherein said plunger member further comprises a serrated edge.

10. The container lid of claim 1, wherein said plunger member comprises a piston.

11. The container lid of claim 1, wherein the top portion and the main portion rotatably engage each other by an annular groove provided on the top portion and an annular protruding ridge provided on the main portion, and said one or more tactile and/or audible indicators comprise a bump provided in the groove of the top portion and a plurality of notches provided on the protruding ridge of the main portion, the bump being in radial alignment with the actuator's minor stem and the notches are in radial alignment with each of the other of the three or more compartments, thereby when the actuator's minor stem comes in alignment with one of the other of the three or more compartments as the top portion is being rotated, the notch that is in radial alignment with said one of the other of the three or more compartments and the bump comes in alignment with each other and produce a tactile and/or audible indication.

12. A container lid for mixture of two or more substances comprising:

a top portion provided with an actuator; and a main portion comprising:

a closed top end, open bottom end and a central axis, said closed top end operably connected to said top portion;

three or more compartments having closed top ends and open bottom ends, wherein said closed top ends of the three or more compartments are incorporated into the closed top end of the main portion of the container lid;

a plunger member provided within each of said three or more compartments, said plunger members connected to the closed top ends of the three or more compartments; and a first sealing member closing the open bottom ends of the three or more compartments, wherein the top portion and the main portion are rotatably attached to each other and rotatable about said central axis, wherein one of the three or more compartments is a major compartment that is larger than the other of the three or more compartments;

wherein said plunger member of said major compartment is located in alignment with said central axis of the main portion and said actuator is always in alignment with the plunger member of said major compartment and the actuator is provided with a major stem for engaging and actuating the plunger member of the major compartment and a minor stem for actuating the plunger member of the other of the three or more compartments, wherein the minor stem is located off-center on the actuator whereby the minor stem is aligned with the plunger member of the other of the three or more compartments by rotating the top portion about said central axis, and the top portion and the main portion are configured with one or more tactile and/or audible indicators for indicating alignment between the actuator's minor stem and one of the two or more compartments.

13. The container lid of claim 12, wherein said plunger members are integrally connected to the closed top ends of the three or more compartments.

14. The container lid of claim 12, wherein the plunger members of said other of the three or more compartments are equidistant in radial direction from the central axis.

15. The container lid of claim 12, wherein said closed top ends of the three or more compartments are integrally formed into the closed top end of the main portion of the container lid.

16. The container lid of claim 12, wherein said plunger members are movable from an initial position to an actuated position and a particular plunger member is moved to the actuated position by aligning the actuator to the compartment associated with said particular plunger member and pushing down on the actuator.

17. The container lid of claim 16, wherein said plunger members are configured to be locked in said actuated position once actuated.

18. The container lid of claim 17, wherein said closed top ends of the three or more compartments are configured as a bellville washer like structure to which the plunger member is centrally connected allowing the plunger member to be locked in the actuated position.

19. The container lid of claim 16, wherein when the plunger member is moved from said initial position to said actuated position, the plunger member unseals the first sealing member.

20. The container lid of claim 19, wherein said first sealing member is a frangible membrane.

21. The container lid of claim 20, wherein when the plunger members are moved from said initial position to said actuated position, the plunger member breaks the frangible membrane.

22. The container lid of claim 12, wherein said plunger members further comprising a serrated edge for puncturing said first sealing member.

23. The container lid of claim 12, wherein said plunger member comprises a piston.

24. The container lid of claim 23, wherein said first sealing member comprises a unidirectional flow valve which expels a substance within said compartment through said unidirectional flow valve when the plunger member is actuated.

25. The container lid of claim 12, further comprising a second sealing member closing the open bottom end of the main portion and defining a main compartment.

26. The container lid of claim 12, wherein the top portion and the main portion rotatably engage each other by an annular groove provided on the top portion and an annular protruding ridge provided on the main portion, and said one or more tactile and/or audible indicators comprise a bump provided in the groove of the top portion and a plurality of notches provided on the protruding ridge of the main portion, the bump being in radial alignment with the actuator's minor stem and the notches are in radial alignment with each of the other of the three or more compartments, thereby when the actuator's minor stem comes in alignment with one of the other of the three or more compartments as the top portion is being rotated, the notch that is in radial alignment with said one of the other of the three or more compartments and the bump comes in alignment with each other and produce a tactile and/or audible indication.

* * * * *